United States Patent [19]

Joyce

[11] 4,384,519

[45] May 24, 1983

[54] APPARATUS FOR IMPRINTING AND PINNING TICKETS

[75] Inventor: Arthur W. Joyce, Framingham, Mass.

[73] Assignee: Dennison Manufacturing Company, Framingham, Mass.

[21] Appl. No.: 204,415

[22] Filed: Nov. 6, 1980

[51] Int. Cl.[3] ..... B41L 45/00

[52] U.S. Cl. ..... 101/69; 101/288; 227/25

[58] Field of Search ..... 101/66–69, 101/288–292, 295; 227/65, 25

[56] References Cited

U.S. PATENT DOCUMENTS

| | | | |
|---|---|---|---|
| 2,438,118 | 3/1948 | Flood et al. | 227/25 X |
| 2,914,768 | 12/1959 | Flood | 227/25 X |
| 2,919,643 | 1/1960 | von Hollen | 101/288 |
| 3,122,995 | 3/1964 | Adler et al. | 101/66 |
| 3,357,618 | 12/1967 | Parker | 227/25 |
| 3,774,530 | 11/1973 | Woodie et al. | 101/66 |
| 3,908,544 | 9/1975 | Seidl et al. | 101/292 |
| 4,023,255 | 5/1977 | Bussard et al. | 227/25 X |
| 4,073,234 | 2/1978 | Sato | 101/292 X |

*Primary Examiner*—Edward M. Coven

*Attorney, Agent, or Firm*—Arthur B. Moore; George E. Kersey; Barry D. Josephs

[57] ABSTRACT

Apparatus is disclosed for imprinting tickets and pinning them onto articles. The printing-pinning machine includes seven functional assemblies driven from a single shaft in a compact arrangement. A strip feed drive handles ticket stock with minimal drag and "pull back", and includes the features of a jogger, and profiled feed pawls. A feed/inking drive system includes mechanical amplification, a ball detent safety feature, and a floating guide rod assembly. Print and sever apparatus are lowered and raised in coordination, to act in sequence on the ticket strip.

13 Claims, 20 Drawing Figures

30

32

APPARATUS FOR IMPRINTING AND PINNING TICKETS

BACKGROUND OF THE INVENTION

The present invention relates to the art of ticketing material by pinning, and more particularly to the preparation of tickets for attachment as by printing. The invention provides a machine including a number of stages which cooperate to advance, print, sever, and attach tickets, the resulting imprinted tickets being readable both by machine and the user.

The assignee of the present invention has been engaged for a number of years in the manufacture of machines for pinning tickets to articles. The machines have primarily resulted from the inventions of Carl A. Flood, as reflected in a number of U.S. patents (e.g. U.S. Pat. Nos. 1,954,287, 1,980,577; 2,042,888; 2,083,150; and 2,914,768). The pinning machine design disclosed in the most recent of these patents includes a pin-bending mechanism for crimping the pointed end of a pin transversely to the surface of a ticket, and features accurate pin-supporting devices which are deployed during insertion of a pin through ticket and article. The design includes a vertically movable anvil for presenting an article to the pinning area, as well as apparatus for feeding pins and driving them through the ticket and article. No one has significantly improved on the pinning machine designs of Flood during the intervening years.

The stages prior to attachment of the ticket, however, have undergone a number of developments in machine design. Many of these developments have reflected the recent trend towards producing tickets which may be read both by machine and by the user, which mandates more rigorous requirements in devices for inking and imprinting the tickets. When items are to be imprintable with many different kinds of characters which can be encountered in practice, the imprinter must be compatible with a wide variety of formats. Where machine readable characters are required, a clarity and quality of printing is required which has not been attainable with traditional imprinters. Serial No. 022,566, assigned to the assignee of the present invention, discloses apparatus for the precision imprinting of articles with prescribed coding formats for machine readable characters.

In designing a machine which combines the functions of imprinting tickets and pinning them onto articles, there are a number of considerations in achieving a satisfactory machine design from the point of view of the user. It is desirable that the machine be as compact as possible, which imposes severe constraints on the layout of functional devices as well as on the design of a power train for operating these devices. Specific requirements of such a machine are that it be compatible with a variety of ticket stocks, that it feed, imprint, and pin these tickets efficiently and safely, and that it be designed in an economical manner, with a minimum of expensive mechanisms.

A functional area of such a machine which is particularly prone to operational difficulties is that of supplying and feeding ticket stock and severed tickets. It is desirable that the machine design minimize the problems of inertia and drag in feeding the ticket stock. Additionally, the apparatus should reduce problems associated with the return cycle of the feed mechanisms. The apparatus should have the capacity to engage and feed tickets without tearing, consistent with efficient operation.

Accordingly, it is a principal object of the invention to provide a machine design for a ticket imprinter-pinner which is compact and economical. A related object of the invention is the achievement of a machine layout which efficiently accomplishes the various functions required in imprinting and pinning tickets. It is another related object to combine or juxtapose the various functional assemblies to the greatest extent possible in order to achieve a compact design. A further related object is the avoidance of expensive mechanisms in the machine design.

Another object of the invention is the provision of ticket feed apparatus which is compatible with high speed operation while handling a variety of ticket stocks. It is desirable that such apparatus minimize inertial and drag effects in supplying and feeding tickets. A specific object is the alleviation of the problem of "pull back". Another related object is the provision of ticket transport apparatus which handles tickets and ticket stock with minimal risk of damage to the tickets.

SUMMARY OF THE INVENTION

The above and further objects are fulfilled in the apparatus of the invention for imprinting and pinning tickets onto merchandise. The apparatus of the invention effects seven functions: inking, strip feed, ticket feed, severing of tickets, printing, raising and lowering of an anvil for pinning, and operation of a pinning head. These various functions are powered from a single drive shaft.

In accordance with one aspect of the invention, inking, ticket feed, and strip feed are combined in a single drive, while the other functions are effected by closely synchronized individual drives. In the preferred embodiment, the drive apparatus includes two dual box cams and one barrel cam, all mounted on a single shaft, acting through linkage associated with each functional subsystem. The functions are integrated to provide maximum displacement, or temporal spread of the individual functions, along with maximum overlap of the functions. By this means, the invention achieves a compact, economical machine design.

Another aspect of the invention is the nature of the common drive for inking, strip feed, and ticket feed. In order to accommodate these functions they are accomplished by devices mounted on a carriage; the machine layout includes a seven inch stroke in reciprocating this carriage. A coupling device provides mechanical amplification for this purpose. The ticket and strip feed drive includes a pair of guide rods with a connecting guide block as a mount for the carriage, thereby providing positive ticket engagement without tearing. The drive apparatus for ticket and strip feed further includes as a safety feature a ball detent mechanism which includes a break-away characteristic on the forward stroke, and an automatic reset on the return stroke.

The strip feed apparatus handles twelve inches of tag stock along with an entry feed loop and stock roll. The apparatus incorporates a jogger to provide a loop of ticket stock and reduce inertial effects on the forward stroke. The ticket strip is fed through ticket guides with a low drag. A feed slot mask, adjustable for a variety of ticket stocks, controls buckling of the stock, in addition to regulating ticket engagement.

The printing and sever drives are synchronized to lower one or more print heads simultaneously with an adjacent sever knife, while avoiding physical interference. The print head completes its descent shortly prior to the knife so that the ticket sever will not affect print quality. These functions occur in a limited time frame relative to ticket/strip feed and inking.

DETAILED DESCRIPTION

Figure 1:
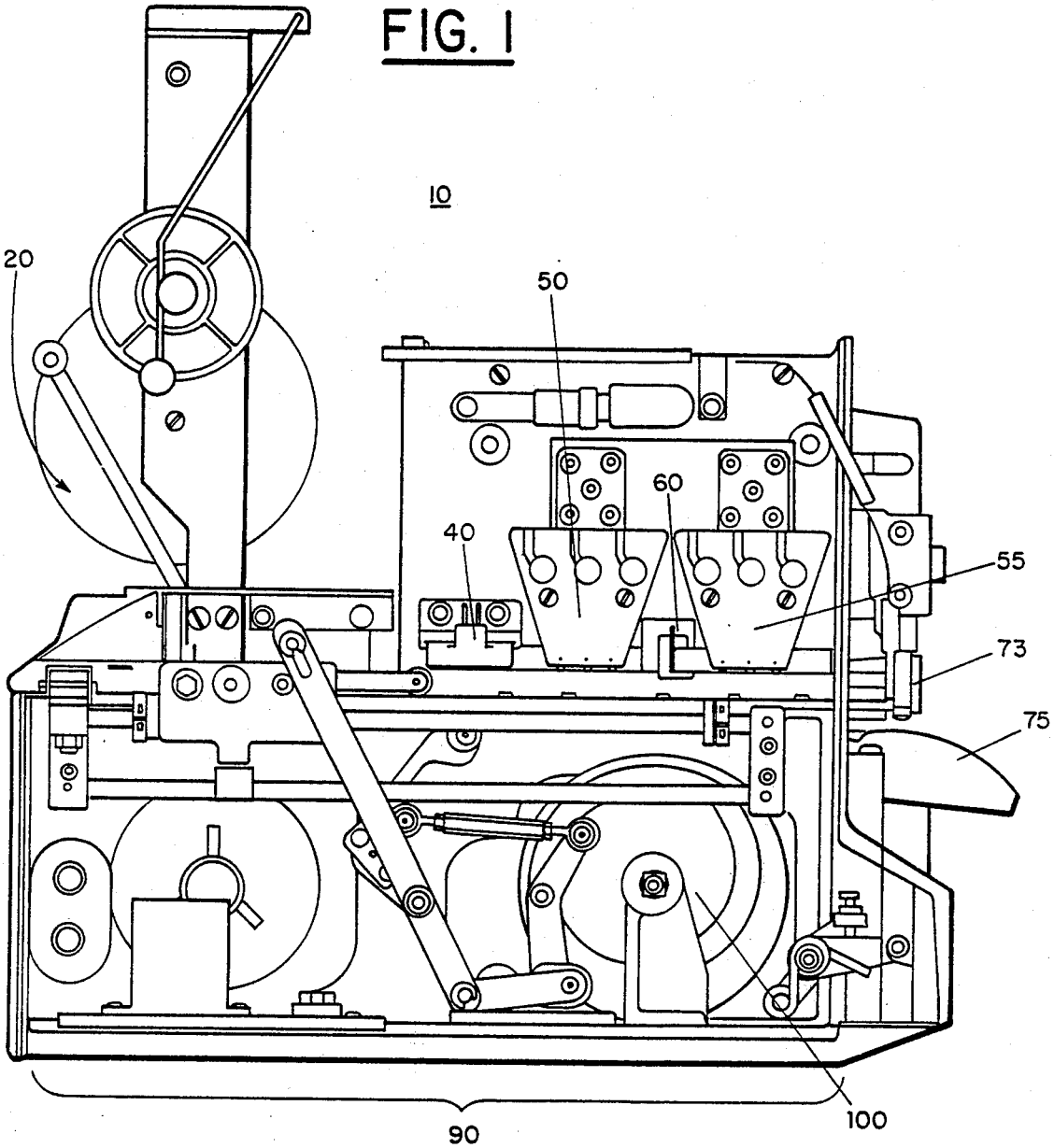
FIG. 1 is a plan view of a printer-pinner in accordance with a preferred embodiment of the invention.

Turning to the drawings, FIG. 1 gives an overview of a printer-pinner 10 in accordance with the invention. The principal operating elements of the printer-pinner 10 include a ticket strip feed assembly 20, an inking assembly 40, one or more print heads 50, a ticket sever knife 60, and a pinning head 73, operating in cooperation with anvil 75. A power train 100 for operating the various assemblies is contained underneath in housing 90.

The imprinter of FIG. 1 is configured to provide precision imprinting regardless of the coding format employed. The machine is particularly suitable for the imprinting of labels and tickets with optically readable characters of the kind shown in the stock S in FIG. 2.

The strip of stock S includes two tickets, s-1 and s-2 with feed apertures a and perforations p between adjoining tickets on the partially imprinted strip S. The label s-1 contains a middle line of characters c-2, while the label s-2 contains outer lines of characters c-1 and c-3. The characters, which are set on the print head 50 as discussed below, somewhat resemble those used in the imprinting of checks for machine processing and have the advantage of being both user and machine readable. It will be understood that the number of lines of coding, the parameters of the characters, and the distribution of code characters on the print head are a matter of choice.

The imprinter-pinner 10 of FIG. 1 may be used to provide labels with ordinary characters by simply interchanging the print head with a print head providing the desired coding format. The imprinter may also be used with a wide variety of non-user readable formats, such as the universal product code, by using a suitable print head.

Figure 2:
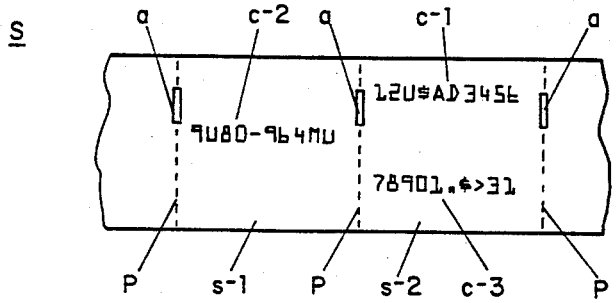
FIG. 2 is a plan view of a representative ticket which has been imprinted with illustrative optical code characters in accordance with the invention.

It is to be noted in connection with the illustrative characters shown in the rows c-1 through c-3 of the tickets s-1 and s-2 that precise character positioning and imprinting are required for correct machine reading. Thus the optically readable characters of FIG. 2 are intended to be read not only by fixed devices, such as at checkout counters, but also be hand held wands which are passed over the imprinted information for detection. In general, machine decoding can take place correctly only if the characters are imprinted with precision.

Thus each ticket or label includes marginal areas where no imprinting is permitted, failing which there will be an error in decoding. In addition each line of print must be properly separated, and the individual characters in any line of imprint must be correctly aligned. Moreover the character sizes and shape must meet prescribed criteria. Edge expansion of the characters, such as that caused by the improper metering of ink, can cause incorrect decoding. The ink coverage must also be relatively uniform, and ink spots outside of the prescribed character area can cause decoding errors.

The imprinter-pinner 10 should be capable of handling a variety of tickets. Other important characteristics of such tickets include the thickness of the ticket (illustratively on the order of 0.1 mil), its severability, and the separation or pitch of the holes a-1, a-2, etc. which are used to engage the ticket stock during transport, as further explained herein.

Figure 3:
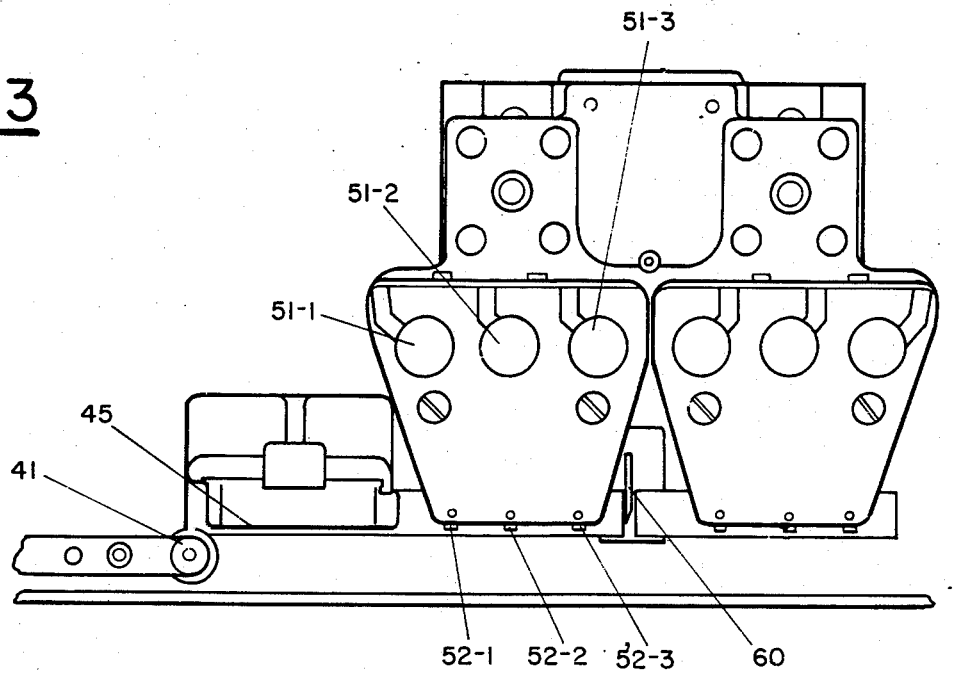
FIG. 3 is a perspective view of a representative print head assembly, sever knife, and inking assembly for the imprinter-pinner of FIG. 1.

Each print head assembly 50, 55 of FIG. 3 illustratively has three sets of bands, 52-1, 52-2, and 52-3, so that three lines of coding, c-1, c-2 and c-3, may appear on each imprinted item. The individual bands are set by knobs 51-1 through 51-3 on the front of the print head.

Figure 4A:
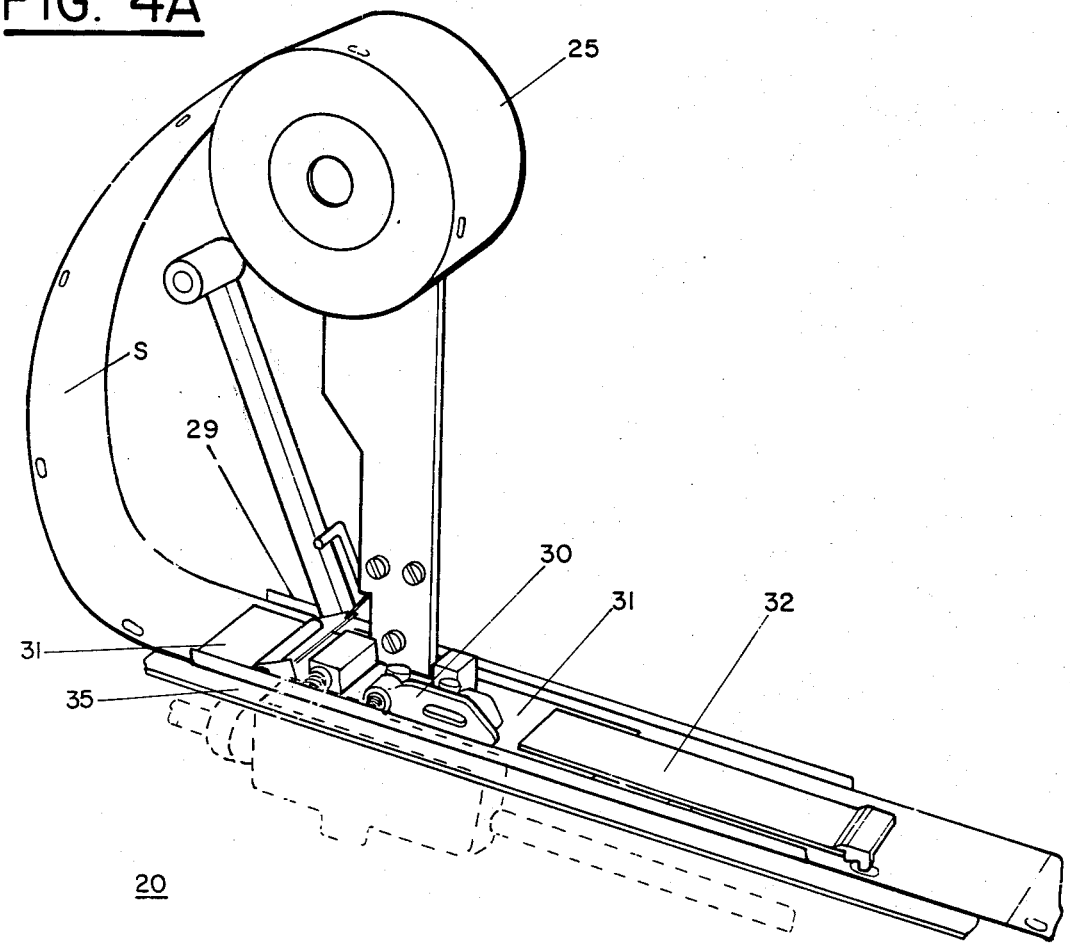
FIG. 4A is a plan view of the ticket path and associated devices of the imprinter-pinner of FIG. 1.
Figure 4B:
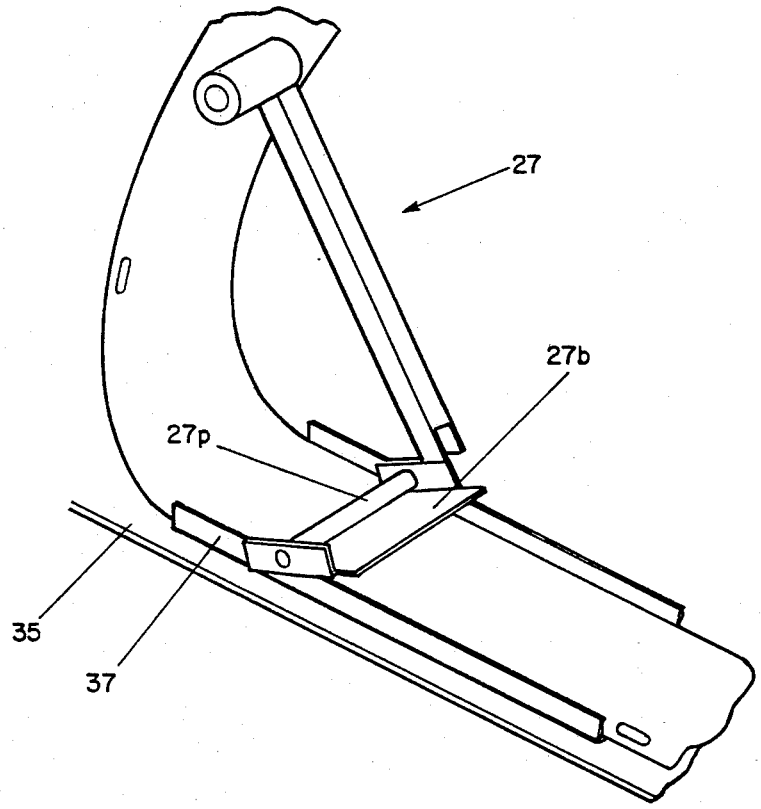
FIG. 4B is a plan view of a preferred form of jogger for use in ticket strip feed.

FIG. 4A gives a plan view of the ticket path and associated devices of imprinter-pinner 10. A strip S of tickets s-1, s-2, etc. in roll form is stored on supply roll 25, and fed therefrom through a jogger 27 to ticket guides 29 which engage the edges of the ticket strip. A preferred form of jogger 27 is illustrated in FIG. 4B. During the return cycle of the ticket strip feed assembly 20, jogger 27 is actuated by contact of its base **27*b* with a block 37 at the trailing edge of the ink feed carriage 35. This causes jogger 27 to pivot at 27*b* in order to pull a loop of ticket stock s from supply roll 25. The availability of a free loop of ticket stock largely avoids inertial drag effects. The ticket guides 29** advantageously are coated with a high lubricity material in order to minimize friction drag effects during the forward cycle.

Figure 4C:
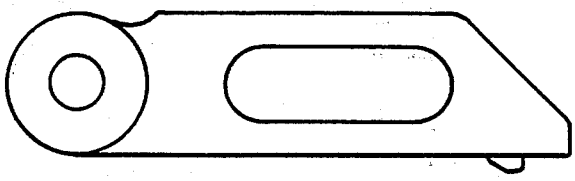
FIG. 4C is a plan view of an illustrative strip feed pawl.

Once engaged by ticket guides 29 the ticket strip passes under a feed slot mask 31 which prevents buckling of the strip during a first portion of its transport between the ticket guides. The ticket strip emerges from feed slot mask 31 to be further engaged by a strip feed pawl or finger 30, which is inserted in one of the feed holes a-1, a-2, etc. between adjacent tickets s-1, s-2, etc. Feed slot mask 31 is adjustably positioned to allow the engagement of ticket strip s by strip feed pawl 30 (FIG. 4C) at the proper location for a ticket strip of a given pitch. This engagement occurs "on the fly", with the feed pawl already moving at full speed. The ticket strip is then conveyed below print heads 50 and 55, where they receive an impression as described above.

During the interval between successive imprintings an ink roller 41 transfers a metered quantity of ink from ink pad 45 to print bands 52 (see FIG. 3). Preferred apparatus to control the contact pressure between the pad 45 and roller 41 is disclosed in Ser. No. 834,776, as is apparatus for cleaning the print bands 57 of print heads 50 and 55. In contrast to this prior art inking apparatus, the inking assembly of the present invention is mounted on a carriage 35 and travels colinearly with feed pawls 30 and 32 (also mounted on carriage 35).

Figure 4D:
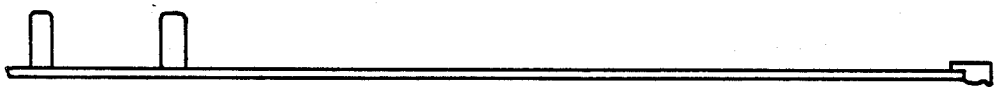
FIG. 4D is a plan view of an illustrative ticket feed pawl.

After imprinting, the ticket strip 20 is severed at perforations P by a knife 60. The individual tickets are pushed from the rear by the edge of a second feed pawl 32 (FIG. 4D), by which means they are conveyed to pinning assembly 70. Pinning assembly 70, including pinning head 73 and anvil 75, advantageously takes the form disclosed in Flood U.S. Pat. No. 2,914,768. As illustrated in the Flood patent, during each machine cycle an anvil 75 rises carrying with it an article A to be labelled, which brings the article into association with a ticket s-1. The article A and ticket s-1 are thus forced upward to the site of printing head 50, where they are held together in a bent condition for reception of a pin.

COMBINED DRIVE APPARATUS

Figure 5:
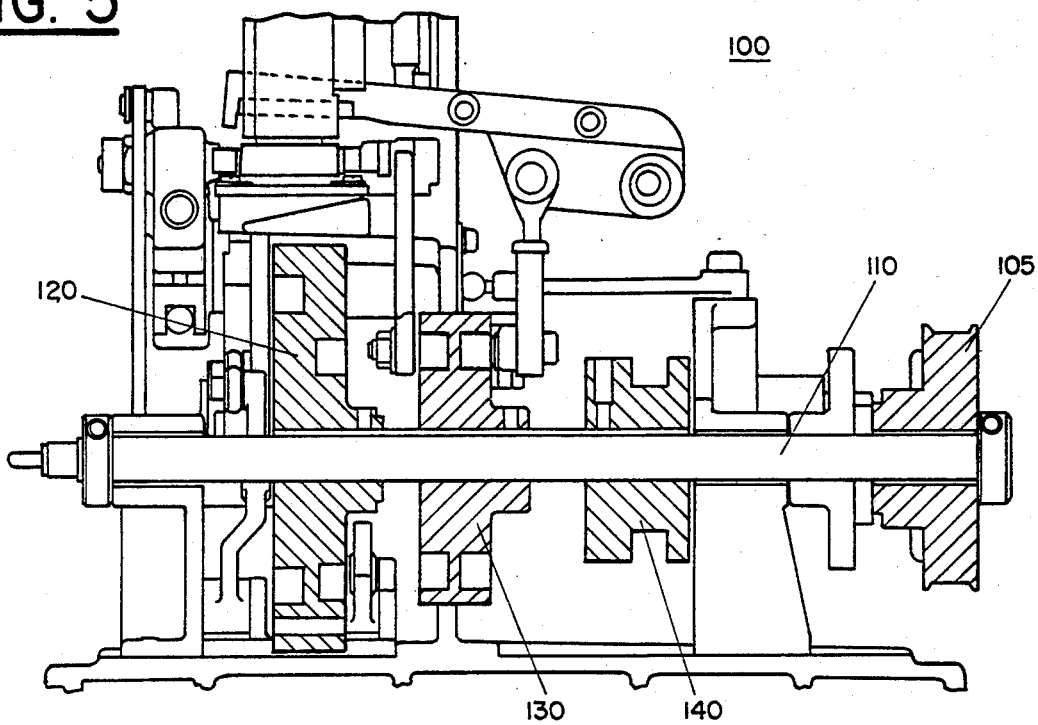
FIG. 5 is an elevation view of the drive assembly for the imprinter-pinner of FIG. 1, as seen from one end.

The imprinter-pinner 10 includes as one of its principal characteristics a common drive assembly 100, which controls the operation of all seven of its subfunctions. The combined drive is powered from a single shaft 110 which is transversely oriented to the direction of ticket feed, on which is mounted dual box cams 120, 130, and barrel cam 140. These are powered from a drive pulley 105. These are shown as seen from one end in FIG. 5. Each of the cams is associated with linkage to govern the operation of individual subfunctions. The single exception is ink/feed cam 120, which controls three subfunctions, as hereinafter disclosed.

By using a single shaft 110 to control all subfunctions of the operation of the printer-pinner 10, the invention utilizes a positive displacement single revolution drive. To provide the basic displacement for each subfunction and thereby design the associated cam profile, it is necessary to map the time output characteristic of each system. It is desirable from the standpoint of economy to integrate the various displacements to achieve optimal acceleration characteristics in a compact design, and avoid undue pressure angles consistent with minimum cam diameters. To this end it is advantageous to "spread out" the various functions, i.e. to provide displacement curves (plots of cam displacement as a function of angle or time) for the subfunctions which are as broad as possible. This is most easily achieved by overlapping the various functions to the greatest extent possible. As a related matter, in designing the linkage associated with functional subsystems, it is necessary to integrate the space relationships of the individual devices in order to achieve a compact design both of drives and outputs.

A number of specific criteria are important in designing the cam displacement functions. The ink/feed curve should be particularly broad, to achieve apparatus which is capable of feeding a variety of ticket lengths in one fixed length stroke by picking up the ticket feed slots on the fly (i.e. without controlled acceleration). This requires a lengthy forward stroke to minimize impact and tearing of the feed slot as well as to accommodate the motion of the inking roller. Similarly, the anvil 75 should begin to rise as early as possible; on the other hand, it is preferable in order to avoid mechanical interference that the ink/feed carriage 35 be withdrawn from its forwardmost point by the time the anvil approaches its highest point. With reference to FIG. 3, which shows a plan view of print heads 50 and 55 together with sever knife 60, it may be seen that these devices must be lowered in coordination to avoid a problem of mechanical interference. Furthermore, it is advisable that the print head or heads be lowered to print position prior to the lowermost descent of sever knife 60 for severing of tickets. This is necessary in order to avoid blurring of the print image and other problems which might occur with simultaneous printing and ticket sever. This may be accomplished by providing a dwell in the descent of the sever knife.

Figure 6:
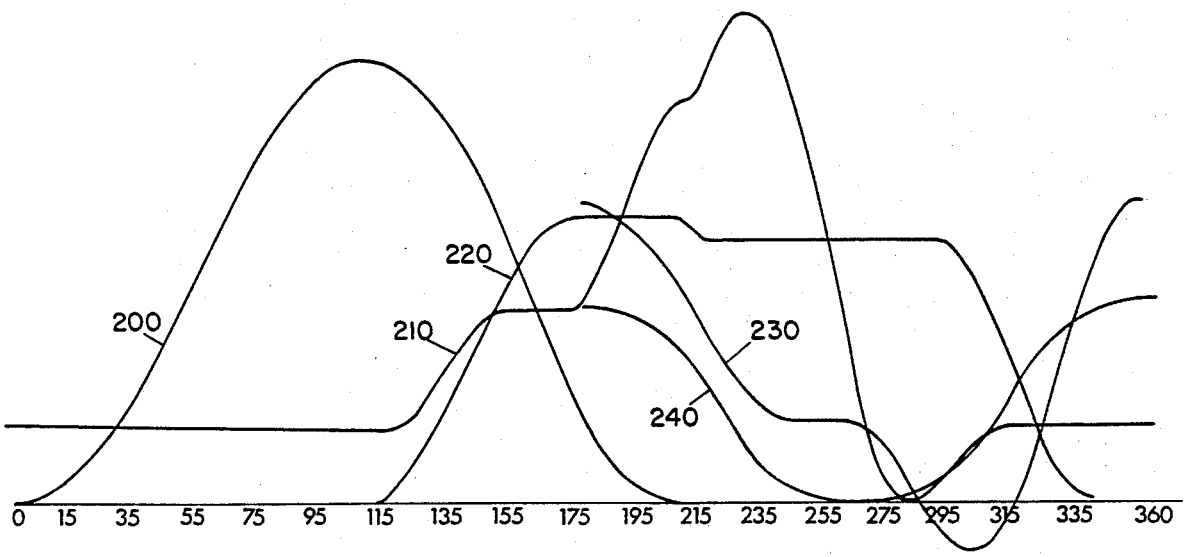
FIG. 6 is a plot of cam displacement as a function of angle for the various functions of the imprinter-pinner of FIG. 1, in accordance with a preferred embodiment of the invention.

FIG. 6 is an illustrative set of displacement plots for the various subfunctions in accordance with the preferred embodiment. These plots include a broad ink/feed curve which includes a small amount of overlap with the broad anvil displacement curve. The print and sever curves show a coordinated descent of the devices, with a dwell of the sever knife shortly prior to printing. The displacement curves of the anvil and pinning head reflect a preferred embodiment of the prior art apparatus disclosed in U.S. Pat. No. 2,914,768.

Figure 7A:
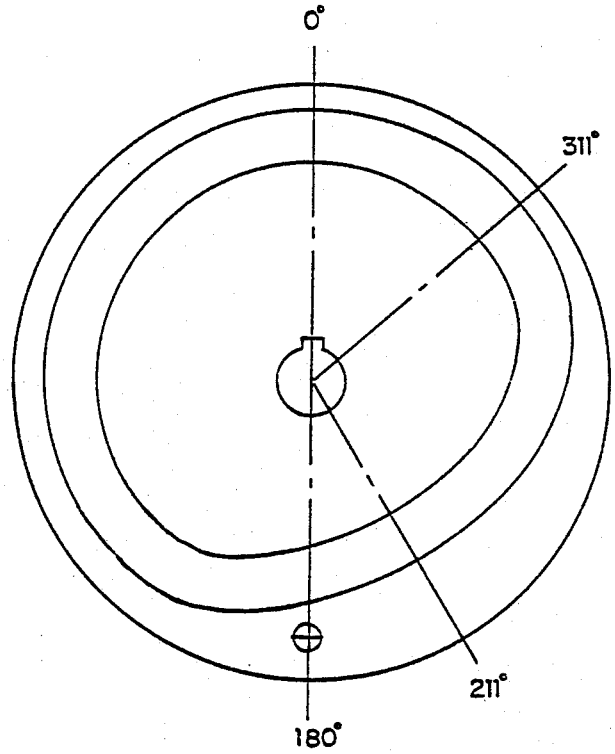
FIG. 7A is a plan view of a preferred ink/feed cam profile in accordance with a displacement curve of FIG. 6.
Figure 7B:
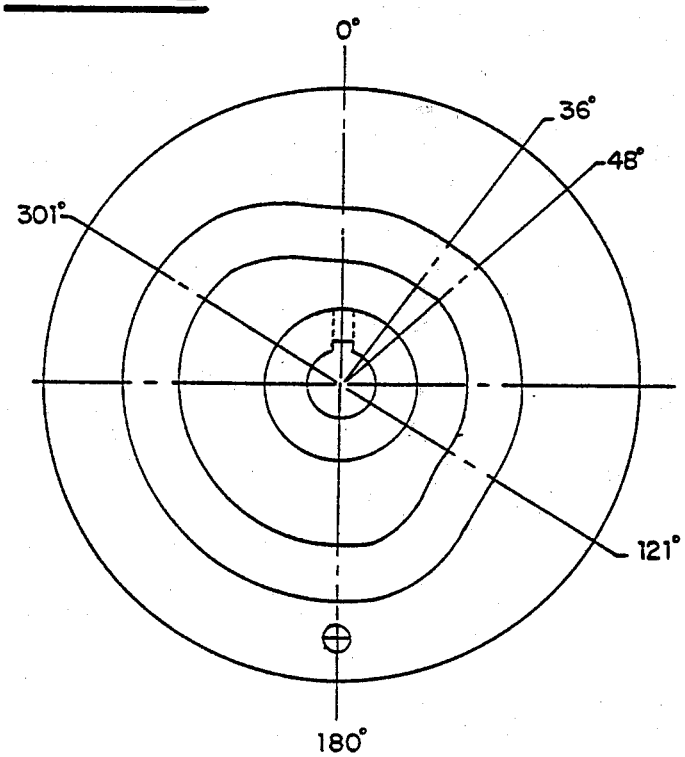
FIG. 7B is a plan view of a preferred anvil cam profile in accordance with a displacement curve of FIG. 6.
Figure 7C:
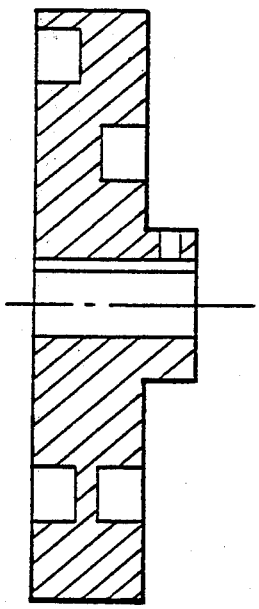
FIG. 7C is a plan view of a combined ink/feed-anvil cam, as seen from the end.
Figure 8A:
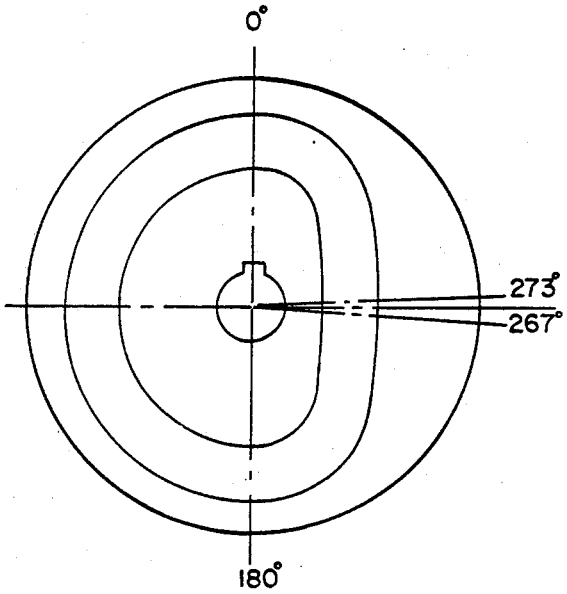
FIG. 8A is a plan view of a preferred print cam profile in accordance with a displacement curve of FIG. 6.
Figure 8B:
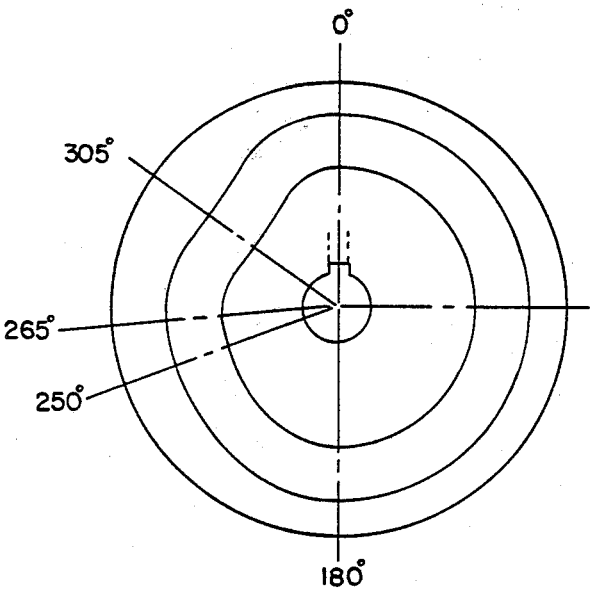
FIG. 8B is a plan view of a preferred sever cam profile in accordance with a displacement curve of FIG. 6.
Figure 8C:
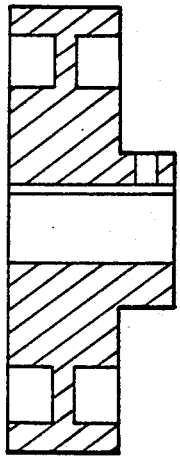
FIG. 8C is a plan view of a combined print-sever cam, as seen from the end.
Figure 9:
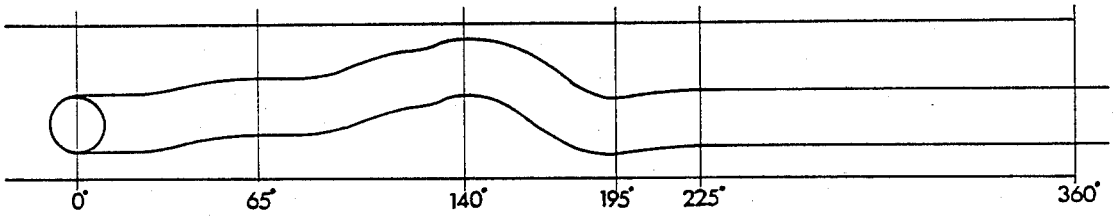
FIG. 9 is a developed view of the pin cam profile.

These curves are reflected in the series of cam profiles illustrated in FIGS. 7 through 9. FIGS. 7A and 7B show respectively the profiles of ink/feed cam 121 and anvil cam 122. As illustrated in FIG. 7C these may be combined as opposite faces of a dual box cam 120. FIGS. 8A and 8B show the preferred cam profiles of print cam 131 and sever cam 131; as seen in FIG. 8C, these are combined as opposite faces of a dual box cam 130. FIG. 9 shows a developed view of the pin cam profile, which represents the perimeter of barrel cam 140.

INK/FEED DRIVE AND MOUNTING APPARATUS

As heretofore mentioned, the functions of feeding the ticket strip, feeding individual tickets, and operation of the inking roller are effected by a unitary drive assembly 100. With reference to the schematic view of FIG. 10, the ink/feed drive apparatus includes box cam 120 mounted on drive shaft 110, mechanical amplifier 150 including a monostable breakaway device 155, and guide rod assembly 160 on which is mounted ink/feed carriage 35.

Figure 10:
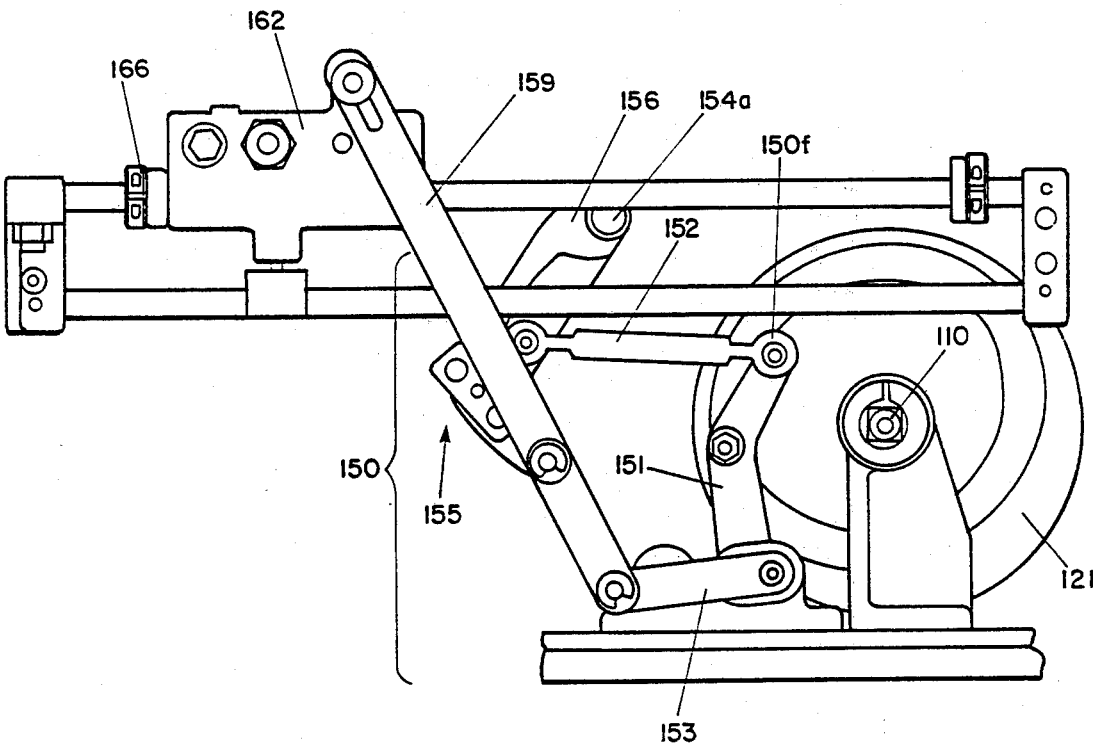
FIG. 10 is a plan view of the ink/feed drive apparatus shown in isolation, in accordance with the preferred embodiment.

As illustrated in FIG. 10 mechanical amplifier 150 converts a short travel of cam follower **150*f* to a lengthy travel of carriage 35**. Illustrative values are a cam follower travel of 0.62 inch, carriage travel of 7.0 inches, representing a mechanical gain of 11 to 1. This is accomplished by two stages to linkage, the first being effected by lever 151 and coupler 153 and the second being effected by coupler 152, bars 154 and 156 and lever 159.

Figure 11:
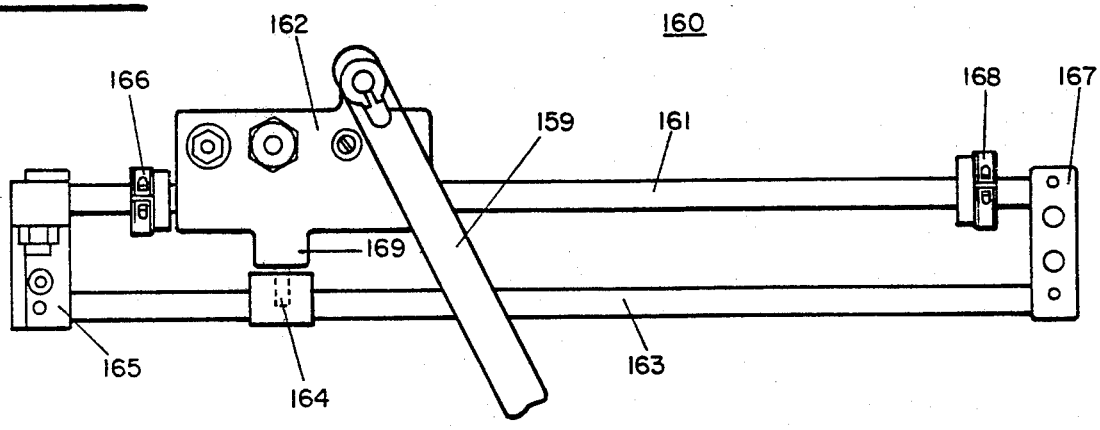
FIG. 11 is a close up view of the guide rod assembly area of the apparatus of FIG. 10.

It is necessary to accurately position carriage 35 on the forward stroke in order to control the location of the feed pawls. This is done by mounting the carriage 35 on a guide rod assembly, as shown in FIG. 11. The guide rod assembly includes upper and lower rod 161 and 163 mounted in parallel in forward and back mounting blocks 165 and 167. Carriage 35, carrying ink roller 41 and feed pawls 30 and 32 is joined to upper guide block 162 which in turn is coupled to lever 159 in order that the carriage motion be regulated by mechanical amplifier 150. Upper guide block 162 in turn is mounted on upper guide rod 161 so that the motion of carriage 35 is constrained, except for rotation around guide rod 161. Such rotation is prevented by the further connection of upper guide block 162 to lower guide block 164, which slidingly engages lower guide rod 163. Upper and lower guide blocks 162 and 164 are telescopingly connected via dowel 169, which provides a "floating" connection permitting unimpeded travel of the guide blocks along guide rods 161 and 163 despite a possible bending of the rods from a parallel orientation.

Figure 12:
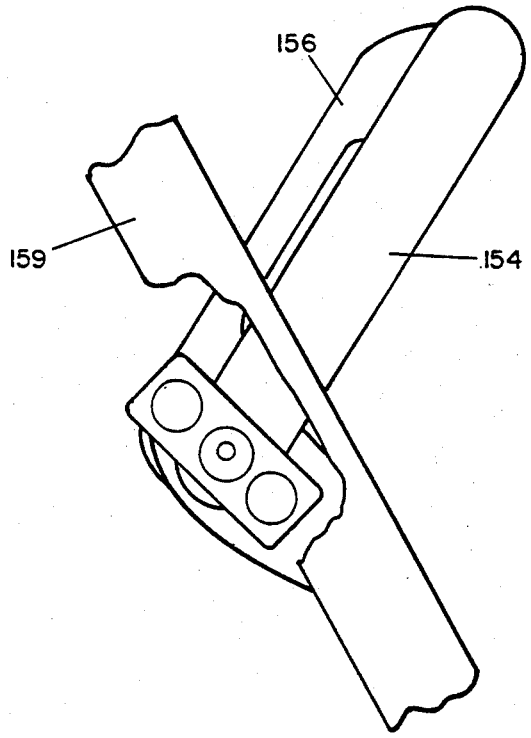
FIG. 12 is an isolation plan view of the break away links of FIG. 10.

Forward and back stops 166 and 168 dampeningly limit the travel of carriage 35 and provide reference locations of feed pawls 30 and 32 for printing and pinning. The ink/feed displacement curve is designed to avoid undue loads on the drive apparatus when the carriage is at its extreme positions. Nevertheless, because of the magnitude of the system gain (illustratively 11 to 1), there is a significant backlash problem. As a safe-guard against a jam in the travel of ink/feed carriage 35, the mechanical amplifier 150 includes a monostable device 155 which disengages the two stages of linkage in the eventuality of an undue load during the forward stroke. The device includes bars 154 and 156, shown in isolation in FIG. 12; bar 154 is linked to coupler 152, while bar 156 is linked to lever 159.

Figure 13:
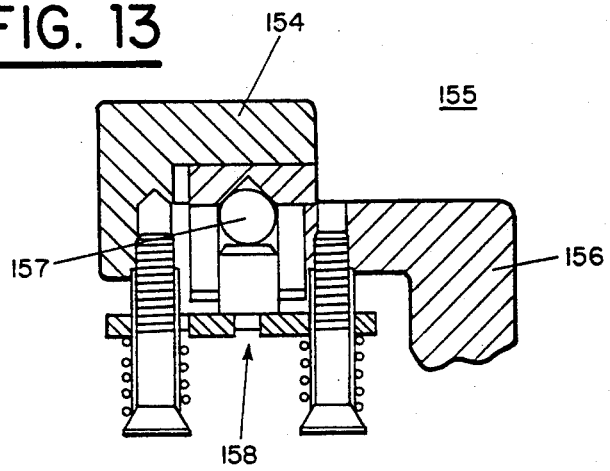
FIG. 13 is a sectional view of the apparatus of FIG. 12.

Bars 154 and 156 are pivotally linked at the upper end 154*a*, and are linked at the lower end by a ball detent device 158. As shown in the sectional view of FIG. 13, the inner bar 156 is detented by a spring loaded ball 157, which fits against a conical seat 154*b* in bar 154. This provides a relatively insensitive breakaway device, with minimal vibrations during the normal operation of mechanical amplifier 150. In the case of an overload during the forward travel of carriage 35, bar 154 will break away at 158 from bar 156, allowing the latter to remain stationary. During the subsequent return cycle, the above device will automatically reset.

While various aspects of the invention have been set forth by the drawings and the specification, it is to be understood that the foregoing detailed description is for illustration only and that various changes in parts, as well as the substitution of equivalent constituents for those shown and described, may be made without departing from the spirit and scope of the invention as set forth in the appended claims.

I claim:

1. In an automatic machine for feeding a ticket strip along a transport axis by advancing the strip with a strip feed pawl, severing tickets from the ticket strip, further advancing the severed tickets along the transport axis with a ticket feed pawl, impressing a print head onto the tickets to imprint them, said print head being adjacent the transport axis, and applying ink to the print head with an ink roller prior to imprinting, the improvement comprising:

a carriage which supports the ink roller, strip feed pawl, and ticket feed pawl;

a guide assembly on which the carriage is mounted to slide along the transport axis;

a rotating drive shaft;

a plurality of cams mounted on said drive shaft to rotate in conjunction therewith; and a mechanical amplifier linking one of said cams to said guide assembly, in order to transmit and substantially amplify a displacement of said cam to reciprocate said guide assembly along the transport axis, wherein said print head is mechanically linked to another of said cams to operate in coordination with the motion of said carriage.

2. Apparatus as defined in claim 1, further comprising means for attaching imprinted tickets to articles, located at the end of the transport axis in the direction of ticket transport, wherein the attaching means is mechanically linked to one of said cams to operate in coordination with the motion of said carriage.

3. Apparatus as defined in claim 2, wherein the attaching means comprises means for inserting pins through tickets and articles, further comprising:

an anvil for supporting articles and conveying them to the attaching site; and linkage driven from one of said cams to reciprocate said anvil.

4. Apparatus as defined in claim 1, wherein the mechanical amplifier amplifies the cam displacement by a factor of around 10:1.

5. Apparatus as defined in claim 1, wherein the mechanical amplifier comprises a four bar linkage comprising a long lever pivotally linked to said guide assembly;

a short lever pivotally linked to said cam by a cam follower; and a pair of coupler arms interconnecting said long and short levers.

6. Apparatus as defined in claim 5 further comprising a monostable device to disengage said long lever from one of said coupler arms during the motion of said carriage in the transport direction if the load on said monostable device exceeds a predefined value.

7. Apparatus as defined in claim 6 wherein the monostable device comprises:

a first bar having a conical indentation, said first bar being joined by one of said coupler arms to said short lever;

a second bar one end of which is pivotally joined to said first bar, said second bar being linked by said long lever to said carriage;

a ball mounted on an opposite end of said second bar; and tensioning means which exerts a force on said ball to fit into the conical indentation of said first bar, in order to retain the ball in the conical indentation unless the load on said monostable assembly exceeds said force.

8. Apparatus as defined in claim 1 of the type in which the ticket strip is fed from a supply roll, further comprising a jogger one end of which is configured to engage a loop of said ticket stock, and another end of which is pivotally mounted adjacent said carriage, wherein said carriage includes a member configured to engage said jogger adjacent the pivotally mounted end during the movement of said carriage, in order to pivot said jogger and pull a loop of ticket stock from the supply roll.

9. Apparatus as defined in claim 1 wherein the guide assembly comprises:

an upper rod;

a lower rod;

a pair of end supports for the rods, said rods being oriented approximately parallel to the transport axis;

an upper guide block, slidingly mounted on said upper rod, said upper guide block being attached to the carriage; and a lower guide block, slidingly mounted on said lower rod, said lower guide block being attached to said upper guide block by a telescoping dowel to permit relative vertical movement.

10. Apparatus as defined in claim 9 further comprising front and back stops mounted on said upper guide rod to dampeningly limit the travel of said upper guide block.

11. In an automatic machine for feeding a ticket strip along a transport axis by advancing the strip with a strip feed pawl, severing tickets from the ticket strip, further advancing the severed tickets along the transport axis with a ticket feed pawl, impressing a print head onto the tickets to imprint them, said print head being located adjacent the transport axis, and applying ink to the print head with an ink roller prior to imprinting, the improvement comprising:

a carriage which supports the ink roller, strip feed pawl, and ticket feed pawl;

a guide assembly on which the carriage is mounted to slide along the transport axis, comprising:

an upper rod;

a lower rod;

a pair of end supports for the rods, said rods being oriented approximately parallel to the transport axis;

an upper guide block slidingly mounted on said upper rod, said upper guide block being attached to the carriage; and a lower guide block, slidingly mounted on said lower rod, said lower guide block being attached to said upper guide block by a telescoping dowel to permit relative vertical movement;

means for reciprocating said carriage along said guide assembly; and means for operating said print head in coordination with the motion of said carriage.

12. Apparatus as defined in claim 11 of the type in which the ticket strip is fed from a supply roll, further comprising a jogger one end of which is configured to engage a loop of said ticket stock, and another end of which is pivotally mounted adjacent said carriage, wherein said carriage includes a member configured to engage said jogger adjacent the pivotally mounted end during the movement of said carriage, in order to pivot said jogger and pull a loop of ticket stock from the supply roll.

13. Apparatus as defined in claim 11 further comprising front and back stops mounted on said upper guide rod to dampeningly limit the travel of said upper guide block.

* * * * *